US005546675A

United States Patent [19]

McGraw et al.

[11] Patent Number: 5,546,675

[45] Date of Patent: Aug. 20, 1996

[54] SINGLE TIER DRYING SECTION APPARATUS

[75] Inventors: William R. McGraw, Beloit, Wis.; Jeffrey H. Pulkowski, Roscoe, Ill.

[73] Assignee: Beloit Technologies, Inc., Wilmington, Del.

[21] Appl. No.: 155,990

[22] Filed: Nov. 22, 1993

[51] Int. Cl.[6] ..... F26B 11/02; D06F 58/00

[52] U.S. Cl. ..... 34/113; 34/115; 34/116; 34/117

[58] Field of Search ..... 34/111, 113, 114, 34/115, 116, 117, 120, 122

[56] References Cited

U.S. PATENT DOCUMENTS

| | | | |
|---|---|---|---|
| 3,946,497 | 3/1976 | Carter | 34/115 |
| 4,905,379 | 3/1990 | Wedel | 34/115 |
| 4,949,475 | 8/1990 | Roerig et al. | 34/117 |
| 4,970,805 | 11/1990 | Wedel | 34/117 |
| 4,980,979 | 1/1991 | Wedel | 34/117 |
| 5,015,336 | 5/1991 | Roerig et al. | 34/117 |
| 5,020,242 | 6/1991 | Mayer et al. | 34/117 |
| 5,024,729 | 6/1991 | Kuhasalo et al. | 34/117 |
| 5,031,338 | 7/1991 | Wedel | 34/117 |
| 5,152,078 | 10/1992 | Wedel | 34/115 |
| 5,347,728 | 9/1994 | Pinter et al. | 34/115 |
| 5,371,954 | 12/1994 | Pinter et al. | 34/115 |

FOREIGN PATENT DOCUMENTS

| | | |
|---|---|---|
| 428471 | 5/1991 | European Pat. Off. . |
| 432571 | 6/1991 | European Pat. Off. . |
| 3913292 | 10/1990 | Germany . |
| 90/01085 | 2/1990 | WIPO . |

*Primary Examiner*—John M. Sollecito
*Assistant Examiner*—Steve Gravini
*Attorney, Agent, or Firm*—Dirk J. Veneman; Raymond W. Campbell; David J. Archer

[57] ABSTRACT

A single tier drying section apparatus is disclosed for drying a web of paper. The drying section includes a first and a second dryer which are disposed in a single tier for drying the web. A vacuum roll is disposed closely adjacent to and between the first and second dryers for guiding the web from the first to the second dryer. The vacuum roll includes a rotatable roll shell having a first and a second end. The shell defines an outer surface and an internal chamber which extends between the first and the second end of the shell. The shell defines a plurality of channels with each channel extending from the chamber to the outer surface such that the chamber is disposed in fluid communication with the outer surface. A vane mechanism is disposed within the chamber for evacuating the chamber. The arrangement is such that a flow of air flows towards the chamber through the plurality of channels for drawing the web into close conformity with the dryer felt when the web extends around the vacuum roll.

11 Claims, 6 Drawing Sheets

SINGLE TIER DRYING SECTION APPARATUS

BACKGROUND OF THE INVENTION

1. Field of the Invention

The present invention relates to a single tier drying section apparatus for drying a web of paper.

More specifically, the present invention relates to a vacuum roll for a single tier drying section.

2. Information Disclosure Statement

The introduction of the Bel-Champ™ single tier drying section at the Quinnesec Paper Machine No. 41 of Champion International was a revolutionary concept in paper drying technology.

Bel-Champ is a common law mark of Beloit Corporation covering the aforementioned single tier drying arrangement in which alternate sides of the web are dried during passage of the web through subsequent alternating top and bottom felted dryer sections. The Bel-Champ™ concept enhanced runnability while restraining the web against cross-machine directional shrinkage thereof.

In another dryer section of the Bel-Champ™ type designed by Beloit Corporation and installed at Ashdown Paper Machine No. 64 for Nekoosa Paper, Inc., the 7 single tier drying sections include a total of 52 vacuum felt rolls, each having a diameter of 26 inches and a shell length of 398 inches.

Each of the aforementioned vacuum rolls includes an outer rotatable shell which defines as many as 1 million holes drilled therein. Additionally, each vacuum roll includes a stationary inner shell, which is also drilled and which includes stationary isolating seals extending between the inner stationary shell and the outer rotating shell.

In order to draw the web towards the felt as the web extends around such vacuum roll, relatively complex internal damper mechanisms are utilized in order to direct and locate the partial vacuum within the vacuum roll in the vicinity of that portion of the vacuum roll being wrapped by the web and felt.

The aforementioned vacuum roll arrangements are complex, and a typical vacuum roll may cost in the region of $100,000.

The present invention overcomes the aforementioned problem by providing a greatly simplified vacuum roll arrangement in which a stationary vane or fin mechanism is located within a rotatable roll shell. The arrangement is such that when the roll shell is rotated by movement of the felt, a clearance exists between the vane or fin without the need for any costly seal arrangement therebetween.

The purpose of the stationary vane(s) or fin(s) mechanism is to prevent the air encompassed by the vacuum roll from rotating with the roll at the roll velocity. Testing has shown that without the aforementioned mechanism, the rotating air encompassed by the roll provides an effective barrier to air entering the vacuum roll. The shear force created by the internal boundary layer of rotating air is perpendicular to the direction of the air trying to enter through the drilled face of the vacuum roll shell. This impediment to air entering the roll prevents the air flow from attracting, and attaching, the paper web to the dryer fabric as it passes over the vacuum roll, the major purposes of this roll.

Flow into the roll can be controlled with a combination of partial vacuum at the roll journal and the clearance between the tips of the fin(s) or vane(s) and the inner surface of the shell. Once a partial vacuum level sufficient to cause flow into the roll has been established at the roll journal, there are two methods of changing the rate of flow:

1) Increasing the partial vacuum level at the roll journal alone will increase the air flow. Decreasing the partial vacuum level alone with have the opposite effect.

2) Increasing the length of the gap between the vane or fin tips and the inner surface of the roll shell will decrease the air flow rate. This is due to the increased depth of the boundary layer of air traveling with the roll shell causing a greater impediment to the air entering the roll through the shell holes. Decreasing the gap from the vane or fin tips to the inner surface of the roll shell has the opposite effect. The impediment is reduced with the thinner boundary layer of air.

Therefore, it is a primary objective of the present invention to overcome the aforementioned inadequacies and problems associated with the prior art arrangements and to provide a vacuum roll for a single tier drying section apparatus which makes a considerable contribution to the art of drying a web of paper.

Another object of the present invention is the provision of a single tier drying section apparatus which includes a vacuum roll having a rotatable roll shell and vane means disposed within a chamber defined by the roll shell, without the need for seals or the relatively costly machining of the internal surface of the shell.

Other objects and advantages of the present invention will be readily apparent to those skilled in the art by a consideration of the detailed description contained hereinafter, taken in conjunction with the annexed claims.

SUMMARY OF THE INVENTION

The present invention relates to a single tier drying section apparatus and method for drying a web of paper. The drying section apparatus includes a first and a second dryer which are disposed in a single tier for drying the web.

A vacuum roll is disposed closely adjacent to and between the first and the second dryers for guiding the web from the first to the second dryer.

A dryer felt extends from the first dryer to and around the vacuum roll. The dryer felt thereafter extends from the vacuum roll around the second dryer such that the dryer felt is disposed between the vacuum roll and the web during movement of the web and the dryer felt around the vacuum roll.

The vacuum roll includes a rotatable roll shell having a first and a second end. The shell defines an outer surface and an internal chamber which extends between the first and the second end of the shell. The shell also defines a plurality of channels, with each channel extending from the chamber to the outer surface such that the chamber is disposed in fluid communication with the outer surface.

In a more specific embodiment of the present invention, the first and second dryer define a first and second peripheral drying surface, respectively. Also, the vacuum roll defines a cylindrical outer surface which is disposed relative to the first peripheral drying surface at a first distance within the range 0 to 12 inches, and relative to the second peripheral drying surface a second distance within the range 0 to 12 inches.

The web is disposed between the dryer felt and the first dryer during movement of the web past the first dryer, the web being disposed between the dryer felt and the second dryer during movement of the web past the second dryer.

The internal chamber extends from the first to the second end of the shell, and the plurality of channels are located between the first and the second end of the shell and are evenly distributed over the outer surface.

The vane means also includes a stationary center shaft which is disposed within and extends along the length of and through the rotatable shell. A fin extends from the stationary center shaft towards the roll shell such that during rotation of the rotatable shell relative to the fin, air flows through the plurality of channels in order to equalize the pressure differential.

More specifically, the fin extends radially relative to the center shaft towards the rotatable shell.

In a further embodiment of the present invention, a further fin is disposed closely adjacent to the fin and extends substantially parallel to the fin so that the fin and the further fin extend from the center shaft towards the rotatable shell.

In another embodiment of the present invention, a further fin extends from the center shaft towards the roll shell with the further fin being disposed substantially diametrically opposite to the fin.

In yet another embodiment of the present invention, the vane means includes a stationary axle and a plurality of fins which extend from the axle and radially therefrom towards the rotatable roll shell.

Another embodiment of the present invention includes a vane means comprising a stationary element of substantially triangular cross-sectional configuration. The arrangement is such that at least some of the apices of the stationary element are disposed in the vicinity of the roll shell.

Another embodiment of the present invention includes a plurality of fins configured as elongate scoops so that relative rotation of the roll shell relative to the fins is accomplished without the need for machining the internal surface of the shell to a close tolerance in order to accommodate a cooperating seal.

Many modifications and variations of the present invention will be readily apparent to those skilled in the art by a consideration of the detailed description contained hereinafter. However, such modifications and variations fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

The present invention relates to a single tier drying section apparatus, generally designated 10, for drying a web of paper W.

Figure 1:
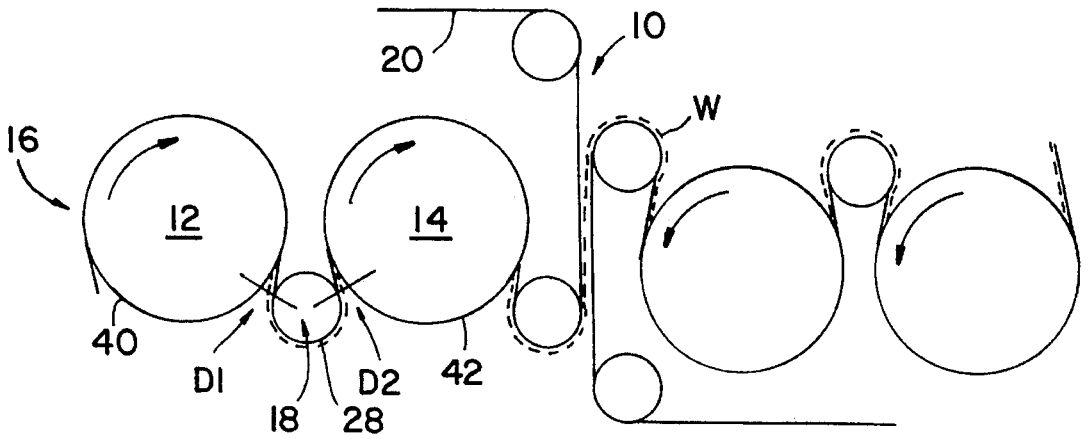
FIG. 1 is a side-elevational view showing a single tier drying section incorporating a plurality of vacuum rolls according to the present invention.

FIG. 1 is a side-elevational view of the single tier drying section apparatus 10, for drying the web of paper W and includes a first and a second dryer 12 and 14, respectively, disposed in a single tier, generally designated 16, for drying the web W.

A vacuum roll, generally designated 18, is disposed closely adjacent to and between the first and second dryers 12 and 14 for guiding the web W from the first to the second dryer 12 and 14, respectively.

A dryer felt 20 extends from the first dryer 12 to and around the vacuum roll 18. The dryer felt 20 thereafter extends from the vacuum roll 18 around the second dryer 14 such that the dryer felt 20 is disposed between the vacuum roll 18 and the web W during movement of the web W and the dryer felt 20 around the vacuum roll 18.

Figure 2:
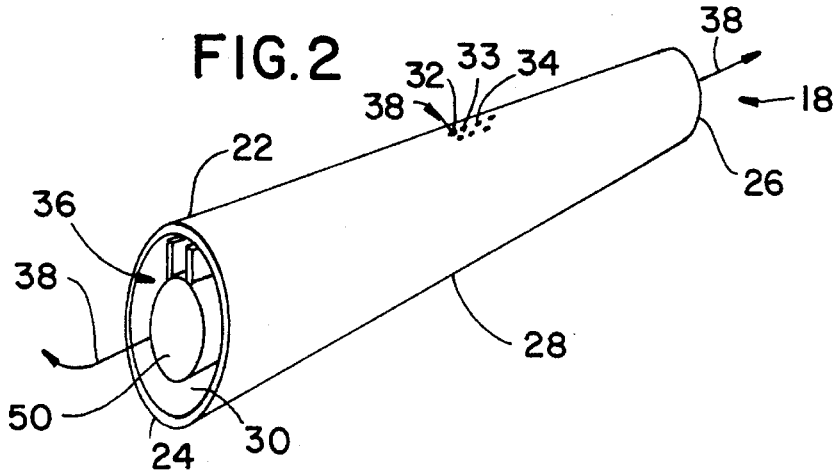
FIG. 2 is an enlarged perspective view of one of the vacuum rolls shown in FIG. 1.

FIG. 2 is a perspective view of the vacuum roll 18 which includes a rotatable roll shell 22 having a first and a second end 24 and 26, respectively. The shell 22 defines an outer surface 28 and an internal chamber 30, which extends between the first and the second end 24 and 26, respectively, of the shell 22. The shell 22 defines a plurality of channels 32,33 and 34. Each of the channels 32–34 extends from the chamber 30 to the outer surface 28 such that the chamber 30 is disposed in fluid communication with the outer surface 28.

Figure 3:
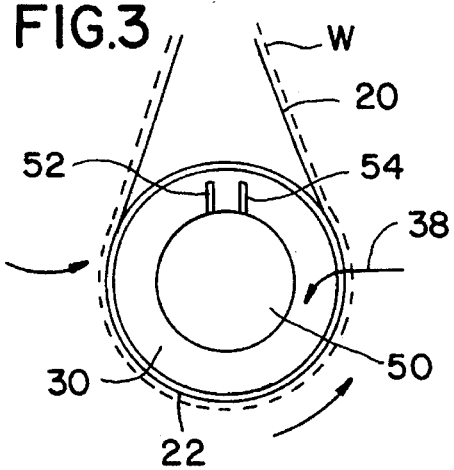
FIG. 3 is an end view of the vacuum roll shown in FIG. 2.

Vane means, generally designated 36, are disposed within the chamber 30 for evacuating the chamber 30. The flow of air 38 is generated by an external air blower or vacuum source 39 for drawing the web W into close conformity with the dryer felt 20 when the web W extends around the vacuum roll 18, as shown in FIG. 3, which is an end view of the roll 18 shown in FIG. 2.

As shown in FIG. 1, the first and second dryer 12 and 14, respectively, define a first and second peripheral drying surface 40 and 42, respectively, as shown in FIG. 1. The vacuum roll 18 defines the cylindrical outer surface 28.

The cylindrical outer surface 28 of the vacuum roll 18 is disposed relative to the first peripheral drying surface 40 a distance $D^1$ within the range 0.1 to 5 inches, and relative to the second peripheral drying surface 42 a second distance $D^2$ within the range 0 to 12 inches.

The web W is disposed between the dryer felt 20 and the first dryer 12 during movement of the web W past the first dryer 12. Additionally, the web W is disposed between the dryer felt 20 and the second dryer 14 during movement of the web W past the second dryer 14.

The internal chamber 30 extends from the first to the second end 24,26 of the shell 22.

The plurality of channels 32 to 34 are located between the first and the second end 24 and 26, respectively, of the shell 22 and are evenly distributed over the outer surface 28.

The vane means, generally designated 36, as shown in FIG. 2, further includes a stationary center shaft 50 disposed within and extending along the length of and through the rotatable shell 22.

FIG. 3 is an end view of the vacuum roll 18 shown in FIG. 2 and shows a fin 52 extending from the stationary center shaft 50 towards the roll shell 22.

The fin 52 extends generally in a radial direction relative to the center shaft 50 towards the rotatable roll shell 22.

As shown in FIG. 3, a further fin 54 is disposed closely adjacent to the fin 52 and extends substantially parallel to the fin 52 so that the fin 52 and further fin 54, respectively, extend from the center shaft 50 towards the rotatable shell 22.

Figure 4:
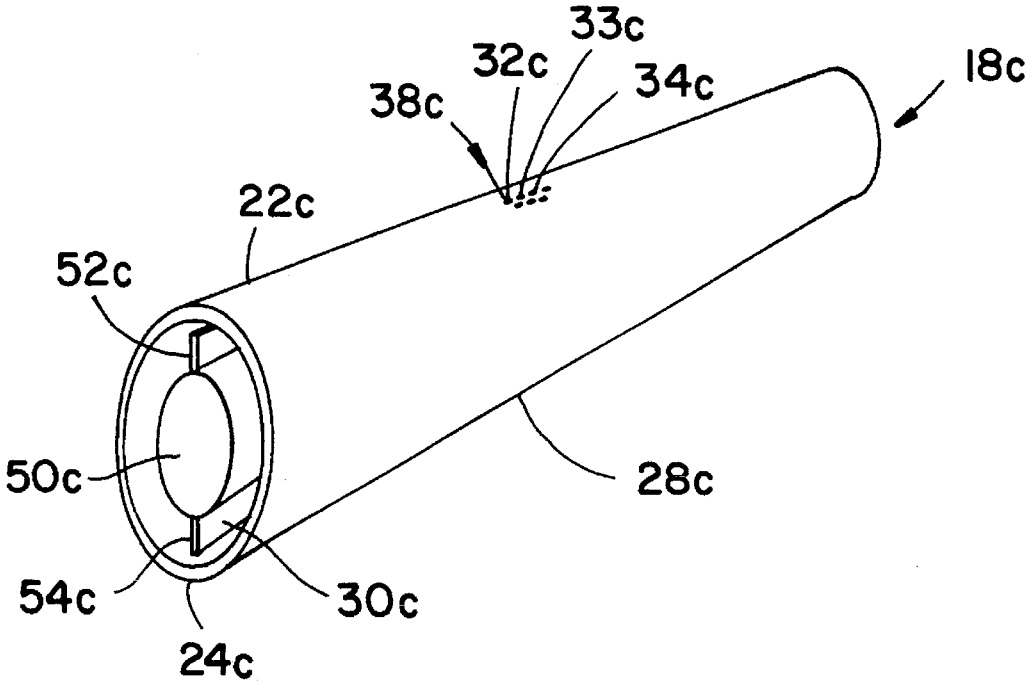
FIG. 4 is a perspective view similar to that shown in FIG. 2, but showing a second embodiment of the present invention.

FIG. 4 is a perspective view of a roll shell 18C according to a second embodiment of the present invention.

As shown in FIG. 4, the further fin 54*c* extends radially from the center shaft 50*c* towards the roll shell 22*c*, with the further fin 54*c* being disposed substantially diametrically opposite to the fin 52*c*.

Figure 5:
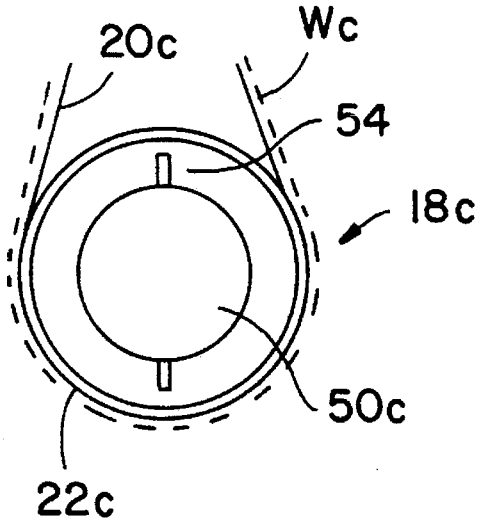
FIG. 5 is an end view of the vacuum roll shown in FIG. 4.

FIG. 5 is an end view of the roll 18*c* shown in FIG. 4.

Figure 6:
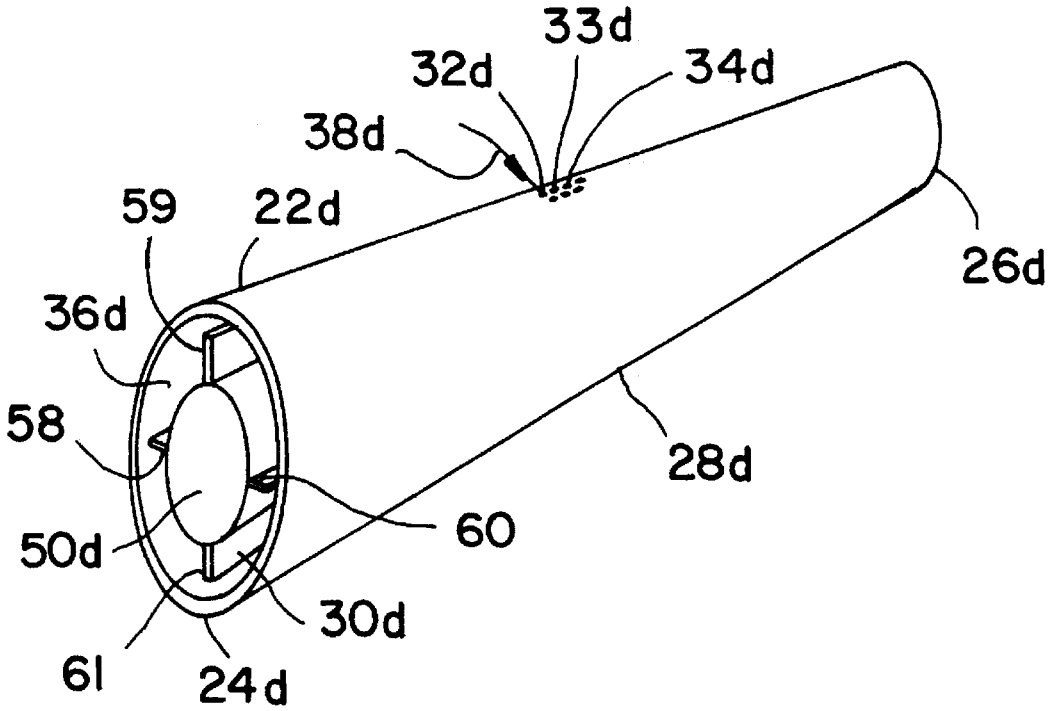
FIG. 6 is a perspective view similar to that shown in FIG. 2, but showing a third embodiment of the present invention.

FIG. 6 is a perspective view of a third embodiment of the present invention. As shown in FIG. 6, the vane means 36*d* includes a stationary axle 50*d* and a plurality of fins 58,59,60 and 61 extending from the axle 50*d* and radially therefrom towards the rotatable roll shell 22*d*.

Figure 7:
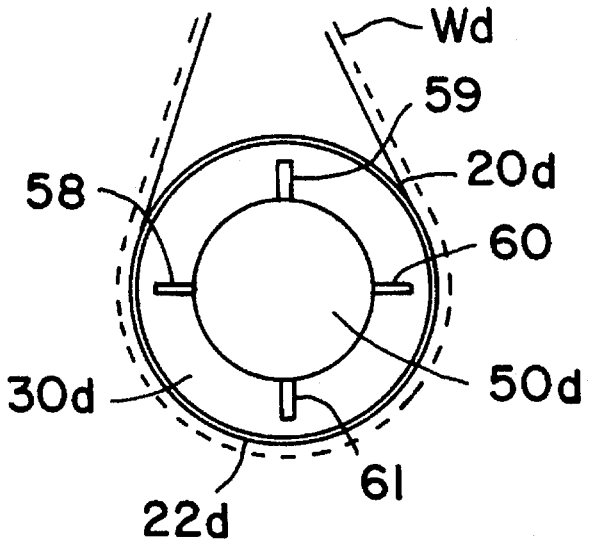
FIG. 7 is an end view of the vacuum roll shown in FIG. 6.

FIG. 7 is an end view of the arrangement shown in FIG. 6.

Figure 8:
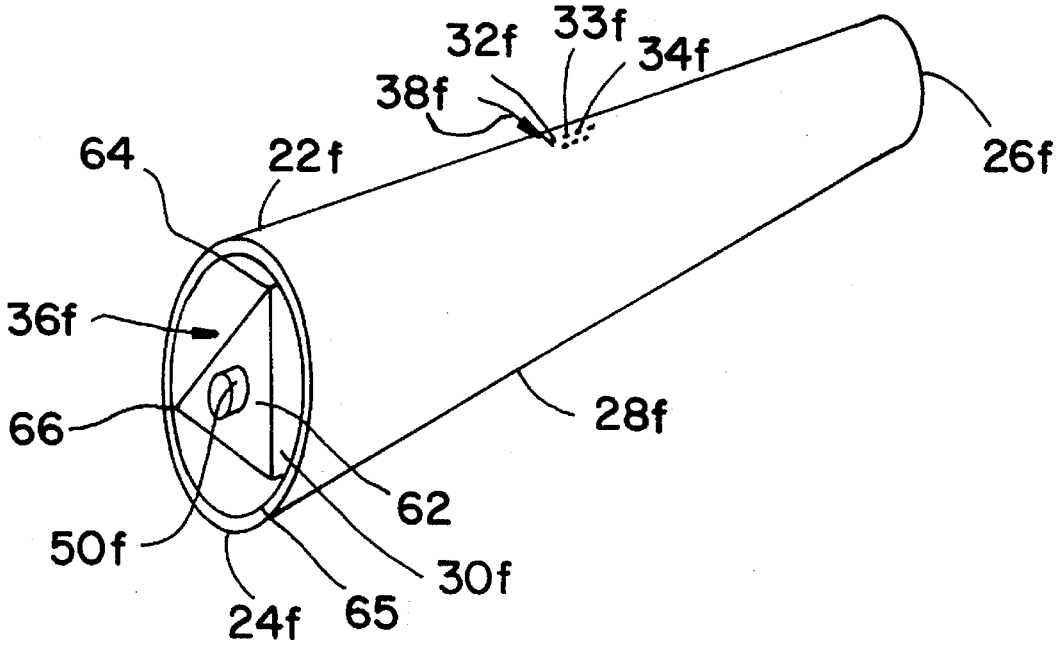
FIG. 8 is a perspective view similar to that shown in FIG. 2, but showing a fourth embodiment of the present invention.
Figure 9:
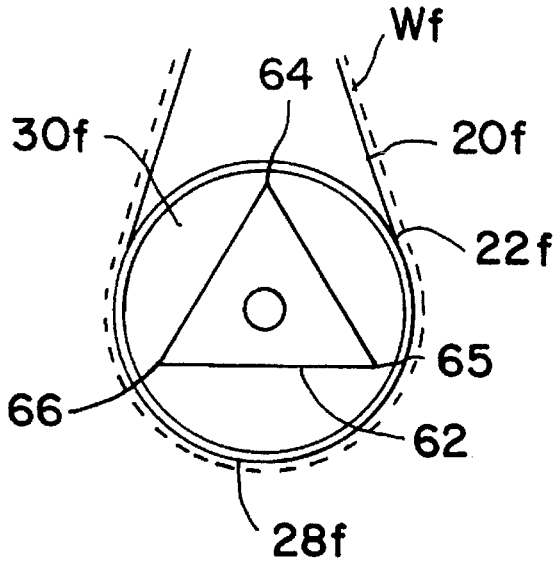
FIG. 9 is an end view of the vacuum roll shown in FIG. 8.

In a fourth embodiment of the present invention, as shown in FIG. 8, the vane means 36*f* includes a stationary element 62 of substantially triangular cross-sectional configuration. The arrangement is such that at least some of the apices 64,65 and 66 of the stationary element 62 are such that air flows, as shown by arrow 38*f*, through the plurality of channels 32*f* to 34*f* into the chamber 30*f* for holding the web Wf onto the dryer felt 20*f*.

Figure 10:
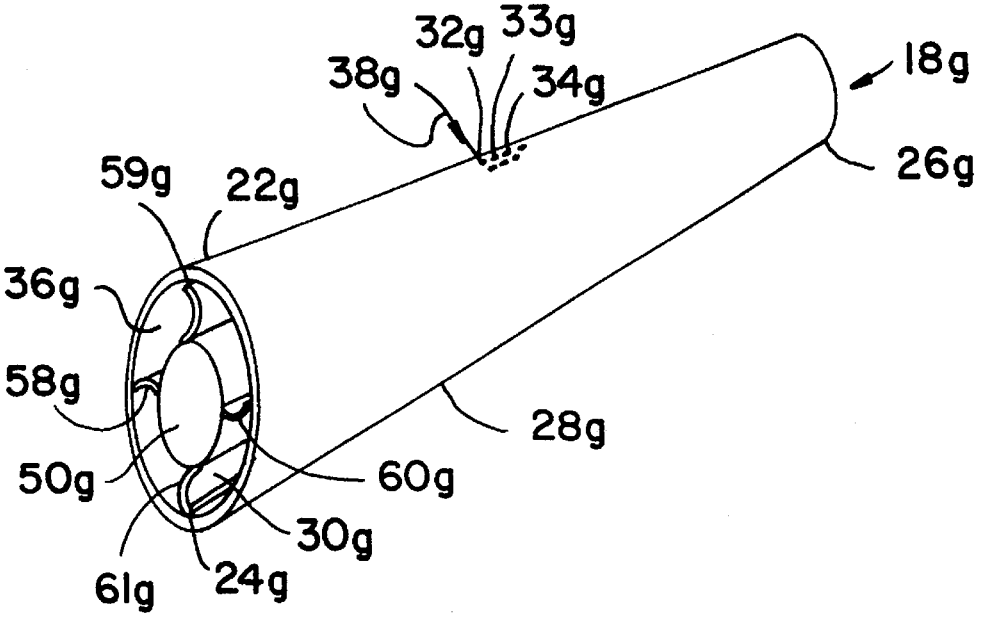
FIG. 10 is a perspective view similar to that shown in FIG. 2, but showing a fifth embodiment of the present invention.

In a fifth embodiment of the present invention, as shown in FIG. 10, the plurality of fins 58*g*,59*g*,60*g* and 61*g* are configured as scoops such that relative rotation of the roll shell 22*g* relative to the fins 58*g* to 61*g* tends to scoop air from within the chamber 30*g*, expelling such air, as shown by arrow 38*g*, through the ends 24*g*,26*g* of the shell 22*g*.

Figure 11:
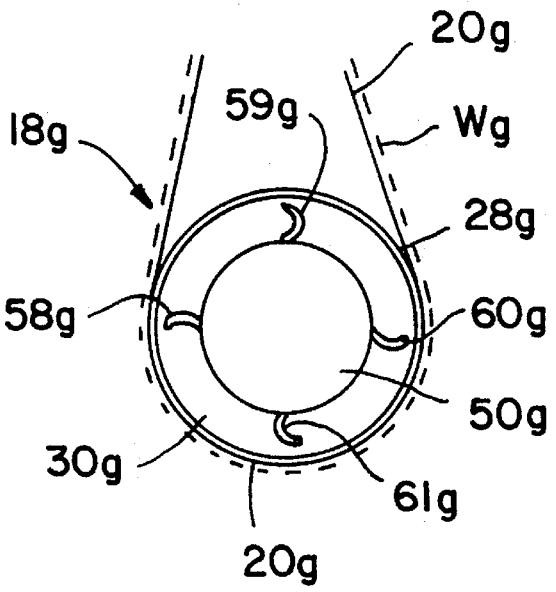
FIG. 11 is an end view of the vacuum roll shown in FIG. 10.

FIG. 11 is an end view of the arrangement shown in FIG. 10.

Figure 12:
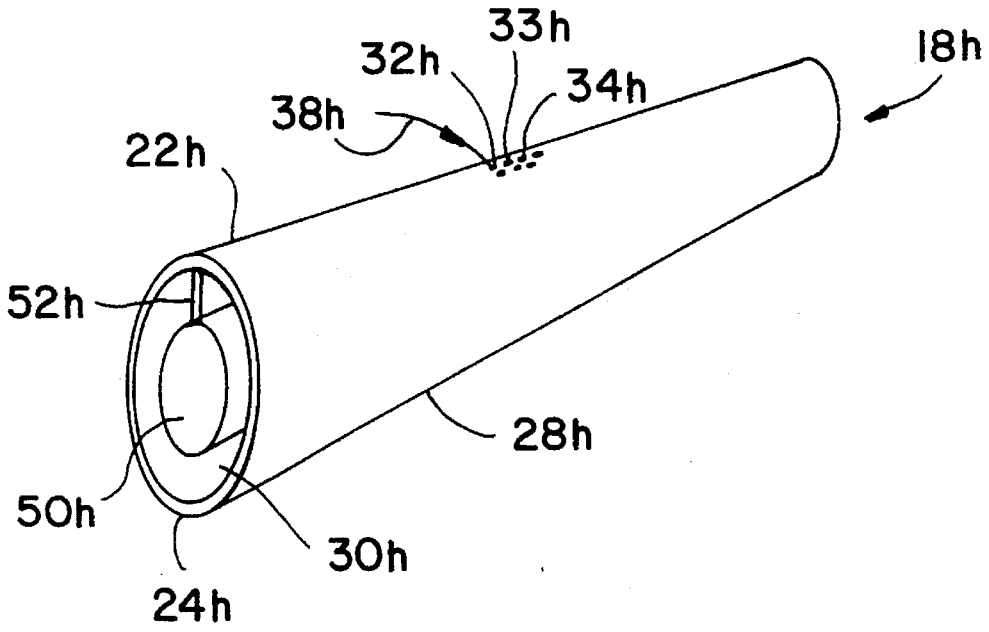
FIG. 12 is a perspective view similar to that shown in FIG. 2, but showing another embodiment of the present invention.
Figure 13:
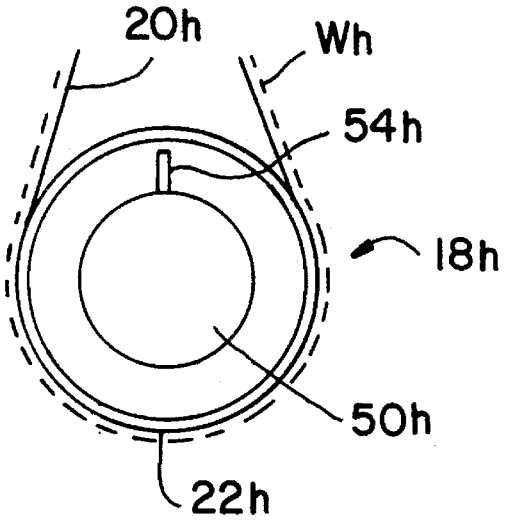
FIG. 13 is an end view of the vacuum roll shown in FIG. 12.

FIG. 12 is a perspective view of another embodiment of the present invention which includes a single fin 54*h*, and FIG. 13 is an end view of the vacuum roll shown in FIG. 12.

Preferably, in each of the aforementioned embodiments, the gap between the tip of the vane or fin to the internal diameter of the vacuum roll is within the range 0.001 inches to 6 inches.

The present invention provides an inexpensive means of fabricating a vacuum roll for a single tier drying section and overcomes the need for relatively complex internal seals and the need for the maintenance of such seals.

What is claimed is:

1. A single tier drying section apparatus for drying a web of paper, said drying section apparatus comprising:

a first and second dryer disposed in a single tier for drying the web;

a vacuum roll disposed closely adjacent to and between said first and second dryers for guiding the web from said first to said second dryer;

a dryer felt extending from said first dryer to and around said vacuum roll, said dryer felt thereafter extending from said vacuum roll around said second dryer such that said dryer felt is disposed between said vacuum roll and the web during movement of the web and said dryer felt around said vacuum roll;

said vacuum roll including:

a rotatable roll shell having a first and a second end, said shell defining an outer surface and an internal chamber extending between said first and second end of said shell, said shell defining a plurality of channels, each channel extending from said chamber to said surface such that said chamber is disposed in fluid communication with said outer surface; and vane means disposed within said chamber and extending continuously along the roll shell within the internal chamber between the said first and second ends, the vane means for cooperating with said shell and being spaced from said shell and stationary relative to said shell, the arrangement being such that during rotation of said shell, a flow of air flows towards said chamber through said plurality of channels for drawing the web into close conformity with said dryer felt when the web extends around said vacuum roll.

2. A single tier drying section apparatus as set forth in claim 1, wherein said first and second dryer define a first and second peripheral drying surface, respectively;

said vacuum roll defining a cylindrical outer surface;

said cylindrical outer surface of said vacuum roll being disposed relative to said first peripheral drying surface a first distance within the range 0 to 12 inches, and relative to said second peripheral drying surface a second distance within the range 0–12 inches.

3. A single tier drying section apparatus as set forth in claim 1, wherein the web is disposed between said dryer felt and said first dryer during movement of the web past said first dryer;

the web being disposed between said dryer felt and said second dryer during movement of the web past said second dryer.

4. A single tier drying section apparatus as set forth in claim 1, wherein said internal chamber extends from said first to said second end of said shell.

5. A single tier drying section apparatus as set forth in claim 1, wherein said vane means further includes:

a stationary center shaft disposed within and extending along the length and through said rotatable shell;

a fin extending from said stationary center shaft towards said roll shell, the arrangement being such that during rotation of said rotatable roll shell relative to said fin, air flows through said channels into said chamber.

6. A single tier drying section apparatus as set forth in claim 5, wherein said fin extends radially relative to said center shaft towards said rotatable roll shell.

7. A single tier drying section apparatus as set forth in claim 5, further including:

a further fin disposed closely adjacent to said fin and extending substantially parallel to said fin so that said fin and further fin extend from said center shaft towards said rotatable shell.

8. A single tier drying section apparatus as set forth in claim 5, further including:

a further fin extending radially from said center shaft towards said roll shell, said further fin being disposed substantially diametrically opposite to said fin.

9. A single tier drying section apparatus as set forth in claim 1, wherein said vane means includes:

a stationary axle;

a plurality of fins extending from said axle and radially therefrom towards said rotatable roll shell.

10. A single tier drying section apparatus for drying a web of paper, said drying section apparatus comprising:

a first and second dryer disposed in a single tier for drying the web;

a vacuum roll disposed closely adjacent to and between said first and second dryers for guiding the web from said first to said second dryer;

a dryer felt extending from said first dryer to and around said vacuum roll, said dryer felt thereafter extending from said vacuum roll around said second dryer such that said dryer felt is disposed between said vacuum roll and the web during movement of the web and said dryer felt around said vacuum roll;

said vacuum roll including:

a rotatable roll shell having a first and a second end, said shell defining an outer surface and an internal chamber extending between said first and said second end of said shell, said shell defining a plurality of channels, each channel extending from said chamber to said outer surface such that said chamber is disposed in fluid communication with said outer surface;

vane means disposed within said chamber for cooperating with said shell, the arrangement being such that during rotation of said shell, a flow of air flows towards said chamber through said plurality of channels for drawing the web into close conformity with said dryer felt when the web extends around said vacuum roll; and said vane means including:

a stationary element of substantially triangular cross-sectional configuration, the arrangement being such that at least some of the apices of said stationary element are disposed in the vicinity of said roll shell.

11. A single tier drying section apparatus as set forth in claim 9, wherein said plurality of fins are configured as scoops.

* * * * *